US008833043B2

(12) United States Patent
Henriksen et al.

(10) Patent No.: US 8,833,043 B2
(45) Date of Patent: Sep. 16, 2014

(54) LIDDING SYSTEM AND LIDS FOR PLASTIC OR METAL CONTAINERS

(76) Inventors: Lars Henriksen, Hellerup (DK); Jorgen Henriksen, Charlottenlund (DK)

( * ) Notice: Subject to any disclaimer, the term of this patent is extended or adjusted under 35 U.S.C. 154(b) by 399 days.

(21) Appl. No.: 12/935,467

(22) PCT Filed: Apr. 25, 2008

(86) PCT No.: PCT/DK2008/050093

§ 371 (c)(1),
(2), (4) Date: Sep. 29, 2010

(87) PCT Pub. No.: WO2009/124546

PCT Pub. Date: Oct. 15, 2009

(65) Prior Publication Data

US 2011/0100986 A1 May 5, 2011

(30) Foreign Application Priority Data

Apr. 9, 2008 (DK) ..... 2008 00518

(51) Int. Cl.
*B65B 7/28* (2006.01)
*B65D 77/20* (2006.01)
*B65B 61/00* (2006.01)

(52) U.S. Cl.
CPC ..... *B65D 77/2024* (2013.01); *B65D 2301/10* (2013.01); *B65D 2577/205* (2013.01)
USPC ..... 53/478; 53/487; 53/476; 53/133.3

(58) Field of Classification Search
USPC ..... 53/476, 478, 133.3, 329.3, 487
See application file for complete search history.

(56) References Cited

U.S. PATENT DOCUMENTS

| | | | | | |
|---|---|---|---|---|---|
| 3,527,020 | A * | 9/1970 | Mancini | 53/282 |
| 3,838,550 | A * | 10/1974 | Mueller | 53/478 |
| 4,176,507 | A * | 12/1979 | Mancini | 53/478 |
| 4,625,498 | A * | 12/1986 | Parsons | 53/526 |
| 4,819,413 | A * | 4/1989 | Mancini | 53/478 |
| 4,862,676 | A * | 9/1989 | Mancini | 53/453 |
| 4,866,913 | A * | 9/1989 | Rebischung | 53/478 |
| 5,371,996 | A * | 12/1994 | Ueda et al. | 53/298 |
| 5,408,805 | A * | 4/1995 | Graffin | 53/487 |
| 6,073,422 | A * | 6/2000 | Massey et al. | 53/471 |
| 6,161,367 | A * | 12/2000 | Walter | 53/478 |
| 6,662,531 | B1 * | 12/2003 | Schwab et al. | 53/453 |
| 7,412,813 | B2 * | 8/2008 | Heil et al. | 53/487 |
| 7,658,296 | B2 * | 2/2010 | Van Handel et al. | 220/23.4 |
| 2007/0295721 | A1 | 12/2007 | Van Handel | |
| 2008/0023366 | A1 * | 1/2008 | Bouthiette | 206/532 |

FOREIGN PATENT DOCUMENTS

| | | | |
|---|---|---|---|
| DE | 8619012 | U1 | 3/1988 |
| DE | 9016043 | U1 | 2/1991 |
| EP | 0135431 | A | 3/1985 |

* cited by examiner

*Primary Examiner* — Thanh Truong
*Assistant Examiner* — Gloria R Weeks
(74) *Attorney, Agent, or Firm* — David A. Guerra

(57) ABSTRACT

The present invention relates to a row of lids (1) defining an unbroken sheet material having a longitudinal direction, the sheet material being shaped so that the rim of the sheet material defines first rims section (3) of the lids (2) and so that second rims sections (4) of two lids (2) being adjacent to each other in the row of lids are defined by one cut in a direction being different from perpendicular to the longitudinal direction (5) of the sheet material.

16 Claims, 2 Drawing Sheets

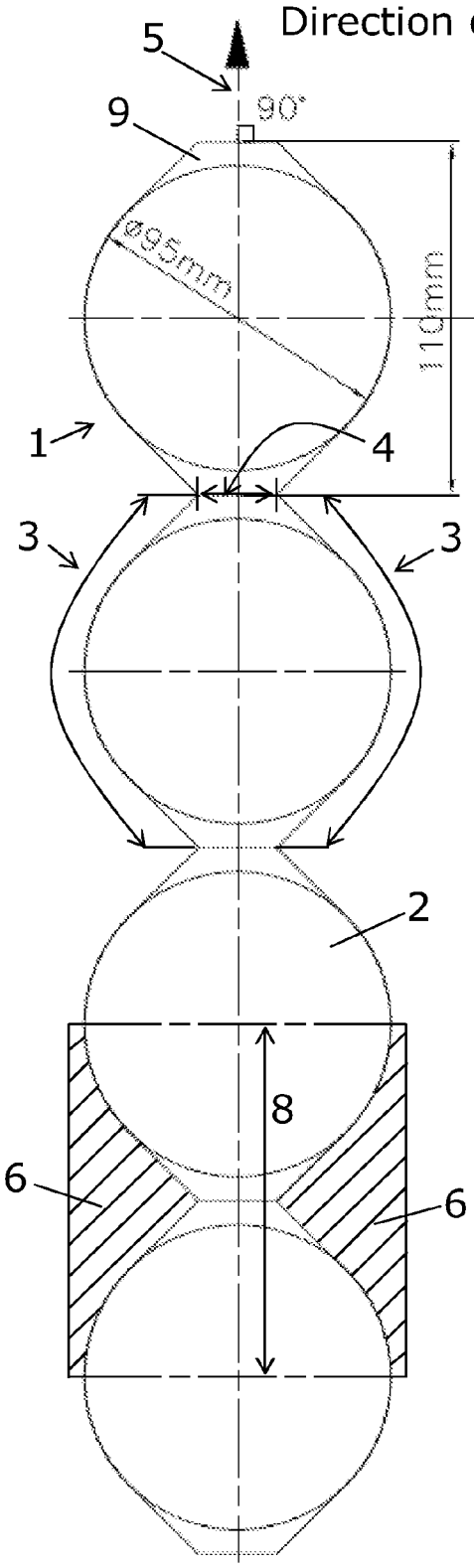
Fig. 1, known art
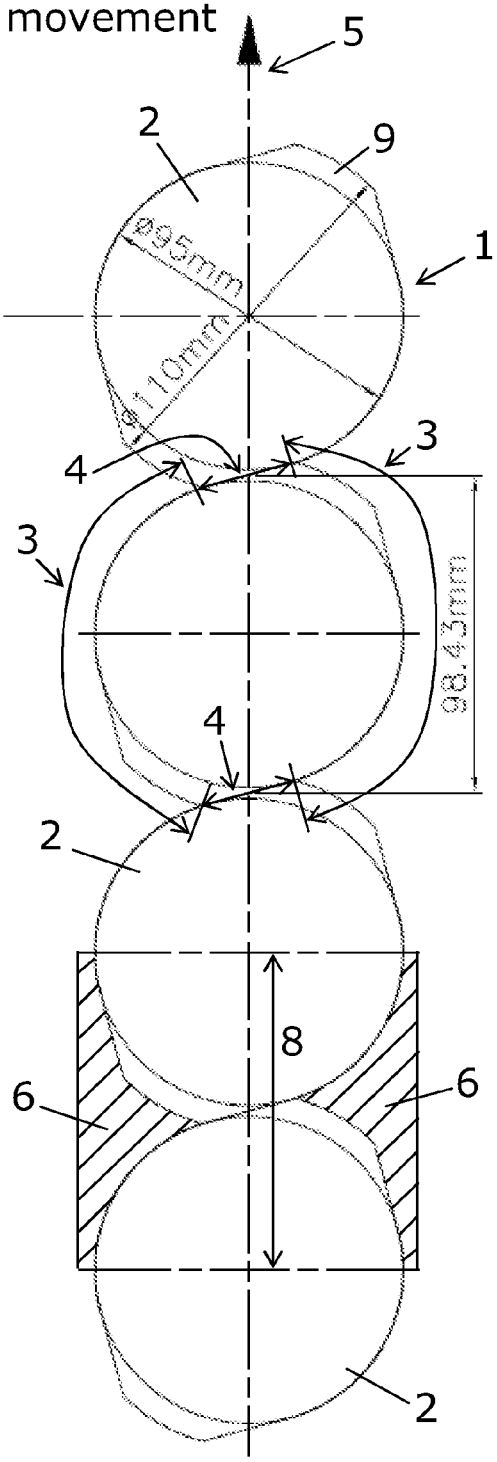
Fig. 2

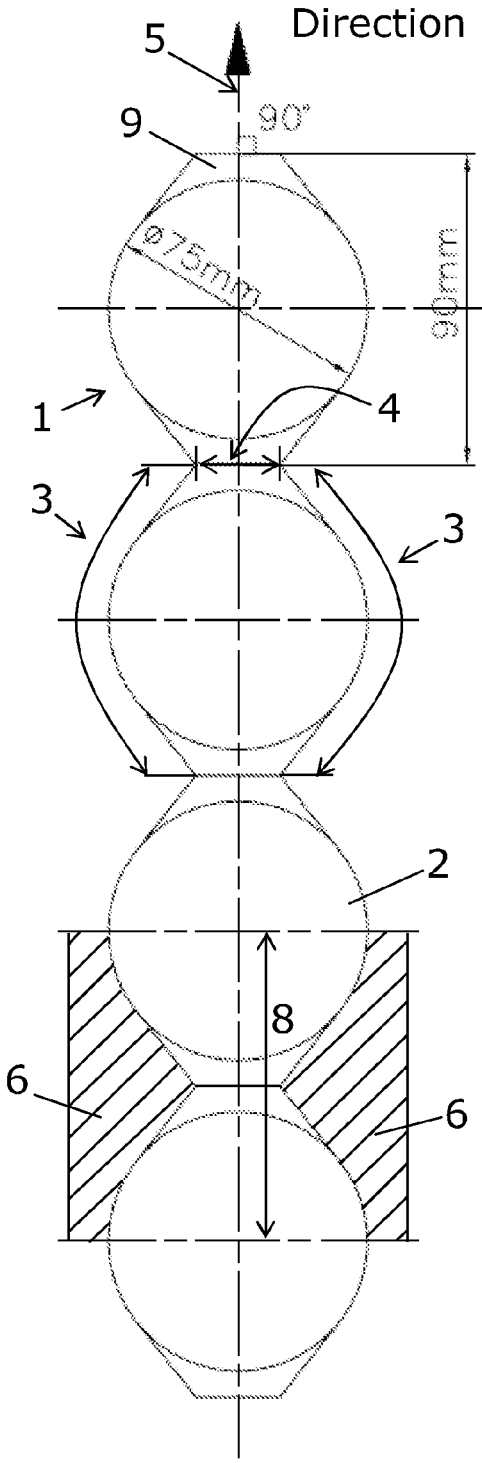
Fig. 3, known art
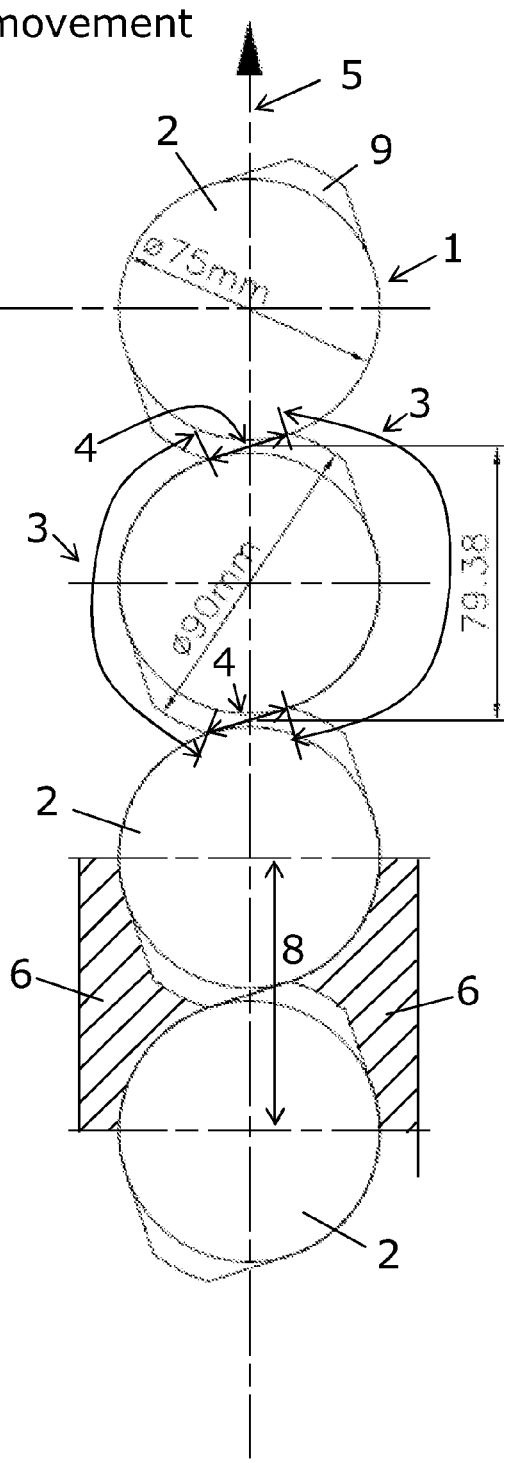
Fig. 4

LIDDING SYSTEM AND LIDS FOR PLASTIC OR METAL CONTAINERS

CROSS-REFERENCE TO RELATED APPLICATIONS

This application is an U.S. national phase application under 35 U.S.C. §371 based upon co-pending International Application No. PCT/DK2008/050093 filed on Apr. 25, 2009. Additionally, this U.S. national phase application claims the benefit of priority of co-pending International Application No PCT/DK2008/050093 filed on Apr. 25, 2009, and Denmark Application No. PA200800518 filed on Apr. 9, 2008. The entire disclosures of the prior applications are incorporated herein by reference. The international application was published on Oct. 15, 2009 under Publication No. WO 2009/124546.

The present invention relates to a row of lids defining an unbroken sheet material having a longitudinal direction, the sheet material being shaped so that the rim of the sheet material defines first rims sections of the lids and so that second rims sections of two lids being adjacent to each other in the row of lids are defined by one cut in a direction being different from perpendicular to the longitudinal direction of the sheet material

INTRODUCTION TO THE INVENTION

Lidding of premade containers usually takes place by placing die cut lids of aluminium or plastic or a laminate of those two materials on the containers and heat sealing them to the containers. These die cut lids are separated from each other and each lid therefore needs to be handled separately, e.g. each lid is taken from a stack of lids by a transporting device and placed on the open end of the container. Such separate handling of lids is time consuming and technically difficult.

A system is also known in which the lids are not completely separated and wound into a roll, from where final separation takes place in a filling and sealing machine by a cut at a right angle to the direction of movement of the row of lids. Such a row of lids can be as shown in FIG. 1.

The row of lids shown in FIG. 1 is cut out from a sheet material and the area indicated by hatching in FIG. 1 is waste material that is removed from the sheet material in order to produce the row of lids.

It is an aim of the present invention to mitigate the problems pertaining to waste material in an efficient lidding system.

DESCRIPTION OF THE INVENTION

In a first aspect the present invention relates to a row of lids defining an unbroken sheet material having a longitudinal direction, the sheet material being shaped so that the rim of the sheet material defines first rims sections of the lids and so that second rims sections of two lids being adjacent to each other in the row of lids are defined by one cut in a direction being different from perpendicular to the longitudinal direction of the sheet material.

In a second aspect, the present invention relates to a method of lidding a container, the method applies a row of lids according to present invention and comprises advancing an end of the row of lids cutting the row of lids at an angle being different from perpendicular to the direction at which the end is advanced to separate a lid from the row of lids.

Thus, the invention pertains to a lidding process, where the lids are not completely separated initially and where the final separation of the lids preferably takes place in a filling and sealing machine by a lidding system, and where the cuts separating the lids are angled in relation to the direction of movement of the row of lids and the angle of the cut separating the lids is not 90° in relation to the direction of movement of the row of lids as the direction of movement preferably is coincident with the longitudinal direction of the row of lids.

By this invention it is possible to reduce the consumption of lidding material compared to the known rows of lids and typically reduce the consumption to a minimum, as by the right choice of cutting angle the centre to centre distance on the row of lids can be reduced.

BRIEF DESCRIPTION OF THE DRAWINGS

The present invention and in particular preferred embodiments thereof will now be disclosed in connection with the enclosed drawings in which:

FIG. 1 shows a known configuration of lids,

FIG. 2 shows an embodiment of a configuration of lids according to the present invention. and FIGS. 3 and 4 show similar to FIG. 1 and FIG. 2 respectively a known configuration of lids and an embodiment of a configuration of lids according to the present invention. The reference signs used in FIGS. 3 and 4 are used for the same features as in FIGS. 1 and 2 respectively.

DETAILED DESCRIPTION OF PREFERRED EMBODIMENTS

FIG. 1 shows a known embodiment of a row of lids 1. The row of lids is in the form of a sheet material where lids 2 are arranged adjacent to each other in a row. The lids each comprising first rim sections 3 which also define the rim of the sheet material. The lids 2 further comprising second rims sections 4, which rim sections are provided by cutting the sheet material perpendicular to the longitudinal direction 5 of the rows of lids. The longitudinal direction 5 is coincident with the direction of movement of the row of lids when they are advanced towards the container in a lidding system.

FIG. 2 shows an embodiment of a row of lids 1 according to the present invention. The row of lids 1 is in the form of a sheet material where lids 2 are arranged adjacent to each other. Again the lids each comprising first rim sections 3 which also define the rim of the sheet material. The lids 2 further comprising second rim sections 4, which rims sections are provided by cutting the sheet material in a direction being different from longitudinal direction 5 of the sheet material. It is noted that by providing one cut, the second rim section 4 of two adjacent lids is provided and that the full rim of a lid preferably consists of first and second rim sections only.

Rows of lids are typically manufactured from cutting a blank in the form of a sheet material so as to define the first sections of the lids in an unbroken sheet material. In FIG. 1 and FIG. 2 the material cut away from the blank for a single lid is shown as the hatched areas 6. It is seen clearly, that it is possible to reduce the consumption of lidding material compared to the known rows of lids (FIG. 1) and typically reduce the consumption to a minimum, as by the right choice of cutting angle the centre to centre distance 8 on the row of lids can be reduced (FIG. 1 and FIG. 2 are drawn in identical scale).

FIGS. 1 and 2 show specific embodiments of a row of lids, wherein each lids is intended for a container with a diameter of 95 mm and pull off tabs 9 with a width of 7.5 mm. The centre to centre distance of the configuration shown in FIG. 1 will be 110 mm, whereas the centre to centre distance of the configuration shown in FIG. 2 is 98.43 mm i.e. a saving in material of approx 10.5%.

FIG. 3 shows a known configuration of lids being identical to the configuration shown in FIG. 1 except from that the lids are scaled down so that each lid is intended for a container with a diameter of being 75 mm in FIG. 3 instead of 95 mm as in FIG. 1. Similarly, the configuration shown FIG. 4 is identical to the configuration shown in FIG. 2 except from that the lids are scaled down so that each lid is intended for a container with a diameter of 75 mm in FIG. 4 instead of 95 mm as in FIG. 4.

For a container with a diameter of 75 mm an pull tab of 7.5 mm the centre to centre distance of the configuration shown in FIG. 3 will be 90 mm, whereas the centre to centre of the configuration shown in FIG. 4 is 79.38 mm which means a sawing of material of approximately 11.8%.

The row of lids 1 according to the present invention is preferably applied in a lidding system where the row is wound into a roll. An end of the row of lids is advanced towards the open end of a container, at which position the lid is cut off the row which provide a second rim section, and sealed to the container.

The invention claimed is:

1. A row of lids comprising:

an unbroken sheet material having a longitudinal direction, said sheet material being shaped so that a rim of said sheet material defines first rim sections of a plurality of lids and so that second rim sections of two of said lids being adjacent to each other in said row of lids are defined by one cut in a direction being different from perpendicular to said longitudinal direction of said sheet material;

wherein each of said lids comprising at least one pull off tab being symmetrically arranged along a line orientated different from perpendicular to said longitudinal direction of said sheet material, said pull off tab includes at least one of said second rim sections.

2. The row of lids according to claim 1, wherein said lids are symmetrical along a line being different from said longitudinal direction of said sheet material.

3. The row of lids according to claim 2, wherein said lids further comprising a heat sealing material along said first and second rims of said lids respectively for heat sealing said lids onto an opening of a container respectively.

4. The row of lids according to claim 3, wherein said row of lids are wound into a roll.

5. The row of lids according to claim 4, wherein said direction in which said cut is to be provided is between 15° and 80° relatively to said longitudinal direction of said sheet material.

6. The row of lids according to claim 1, wherein said sheet material is made from a material selected from the group consisting of aluminum, paper, and plastic.

7. The row of lids according to claim 1, wherein said at least one pull off tab of each of said lids is a first pull off tab and a second pull off tab symmetrically arranged opposite of said first pull of tab.

8. The row of lids according to claim 7, wherein said second rim sections comprises a portion of said first pull off tab of a first of said two lids and a portion of said second pull off tab of a second of said two lids adjacent with said first of said two lids.

9. A method of lidding a container, said method comprising the steps of:

a) providing a row of lids on an unbroken sheet material having a longitudinal direction, said sheet material being shaped so that a rim of said sheet material defines first rim sections of a plurality of lids and so that second rim sections of two of said lids being adjacent to each other in said row of lids, wherein each of said lids comprising at least one pull off tab being symmetrically arranged along a line orientated different from perpendicular to said longitudinal direction of said sheet material, said pull off tab includes at least one of said second rim sections;

b) advancing an end of said row of lids in said longitudinal direction; and c) cutting said row of lids at an angle being different from perpendicular to said longitudinal direction so as to define a second rim of said lids respectively, at which said end is advanced to separate at least one of said lid from said row of lids.

10. The method according to claim 9 further comprising the step of d) sealing said at least one of said lid to said container via a heat sealing material located on said first and second rims of said at least one of said lid.

11. The method according to claim 10, wherein said end of said row of lids is advanced from a wound roll of said row of lids.

12. The method according to claim 11, wherein said lids are symmetrical along a line being different from said longitudinal direction of said sheet material.

13. The row of lids according to claim 12, wherein said angle in which said cut in step c) is to be provided is between 15° and 80° relatively to said longitudinal direction of said sheet material.

14. The method according to claim 9, wherein said sheet material is made from a material selected from the group consisting of aluminum, paper, and plastic.

15. The row of lids according to claim 9, wherein said at least one pull off tab of each of said lids is a first pull off tab and a second pull off tab symmetrically arranged opposite of said first pull of tab.

16. The row of lids according to claim 15, wherein said second rim sections comprises a portion of said first pull off tab of a first of said two lids and a portion of said second pull off tab of a second of said two lids adjacent with said first of said two lids.

* * * * *